United States Patent [19]

Schad

[11] Patent Number: 4,648,312

[45] Date of Patent: Mar. 10, 1987

[54] APPARATUS FOR VENTILATING AN ENCLOSED AREA

[76] Inventor: Louis A. Schad, 19643 Friar, Reseda, Calif. 91335

[21] Appl. No.: 736,229

[22] Filed: May 20, 1985

Related U.S. Application Data

[63] Continuation-in-part of Ser. No. 544,569, Oct. 24, 1983, abandoned.

[51] Int. Cl.[4] ..... F23L 17/10

[52] U.S. Cl. ..... 98/75; 416/227 A

[58] Field of Search ..... 98/21, 69, 72, 75; 416/171, 185, 227 A

[56] References Cited

U.S. PATENT DOCUMENTS

| | | | |
|---|---|---|---|
| 74,655 | 2/1868 | Worth | 98/72 |
| 209,552 | 11/1878 | Demond et al. | 98/72 |
| 1,416,295 | 5/1922 | Hirschman | 98/75 |
| 1,649,161 | 11/1927 | Foster | 416/185 |
| 1,702,120 | 2/1929 | Kimball | 98/72 |
| 2,013,244 | 9/1935 | LaVergne | 98/72 |
| 2,227,852 | 1/1941 | Smith | 98/72 |
| 4,093,401 | 6/1978 | Gravelle | 416/185 |

FOREIGN PATENT DOCUMENTS

| | | | |
|---|---|---|---|
| 7887 | of 1891 | United Kingdom | 98/75 |
| 15369 | of 1893 | United Kingdom | 98/72 |
| 190969 | 1/1923 | United Kingdom | 98/72 |

*Primary Examiner*—Harold Joyce
*Attorney, Agent, or Firm*—David O'Reilly

[57] ABSTRACT

An apparatus for ventilating an enclosed area comprised of a hemispherical dome-like head assembly covering an exit hole to an enclosed area to be ventilated, an external wind driven fan, and high efficiency internal exhaust fan blades adjacent to the exit hole being coupled to the wind driven fan. The external and internal fans are designed to be separated by the hemispherical dome-like covering over a vent tube and operate in conjunction with one another but are functionally independent. The high efficiency specially configured internal fan provides power to exhaust the air while the external fan provides the driving force. The external fan is provided by a series of vanes or fins on the external surface of the hemispherical dome-like covering while the internal fan is provided in the form of a series of specially configured fan blades beneath the hemispherical dome-like covering. The specially configured fan blades have curved flanges along a lower edge progressing into a concave surface lifting and discharging air from a vent tube. The hemispherical dome-like covering is supported on a tube shaped base capable of being mounted on an exhaust tube or roof stack positioned over the exit hole.

9 Claims, 8 Drawing Figures

APPARATUS FOR VENTILATING AN ENCLOSED AREA

REFERENCE TO RELATED APPLICATION

This application is a Continuation-In-Part of patent application Ser. No. 544,569 filed Oct. 24, 1983 now abandoned.

FIELD OF THE INVENTION

This invention relates to ventilating devices and more particularly relates to an improved wind driven ventilating devices

BACKGROUND OF THE INVENTION

Present wind powered turbine rotary ventilators are in the form of a series of fins forming a substantially spherical shape mounted on an exhaust tube or roof stack for ventilating an enclosed area. The standard, or general type of configuration provides vanes or blades which perform the dual function of both driving the rotary turbine head and are also simultaneously acting as the exhaust fan to draw air from the enclosed area through an exhaust tube that it is mounted on. Because of this dual action, the wind or driving force striking a substantial area of the rotary turbine head decreases or cancels out a portion of the exhausting function of the vanes. Additionally, because the vanes provide a substantially vertical open area between each vane, water and other weather elements can pass through the ventilator into the enclosed area.

It would be advantageous if the wind powered ventilating apparatus could be designed to be completely independent of the exhausting fan. That is, the fan for providing the motive force would be independent and separated from the exhaust fans which draws the air from the enclosed area to be ventilated.

Therefore, it is one object of the present invention to provide a wind powered ventilating apparatus in which the wind powered fan functions independently of the exhaust fan.

Still another object of the present invention is to provide a wind powered ventilator in which the wind powered fan is separated from the exhaust fan by a hemispherical dome-like covering which prevents weather elements from entering the enclosed area being ventilated.

Still another object of the present invention is to provide a wind powered exhaust fan in which the wind powered fan and the exhaust fan are attached to the same hemispherical dome-like covering over the exit hole for the area to be ventilated.

BRIEF DESCRIPTION OF THE INVENTION

This invention is for the purpose of providing an improved wind powered rotary ventilating apparatus having improved efficiency over existing wind powered turbine rotary ventilators.

The present invention provides a turbine or rotary wind powered turbine head ventilator that incorporates two cooperating fan systems which function independently. An external fan provides the rotary driving force to the turbine head and separate internal exhaust fan coupled to, and being driven by, the external fan to exhaust or ventilate air from an enclosed area. The external and internal fans are connected together by a rod for rotation on the same axis and yet at the same time are substantially independent in function. Thus, the exhaust fan functions independent of the external motive fan and therefore does not compete with the motive fan providing improved efficiency.

Further the exhaust fan is provided in the form of a plurality of blades, fins or vanes on a hemispherical dome-like head which covers the exit hole to an area to be ventilated. The internal exhaust fan is provided as a plurality of vanes on the interior surface of the hemispherical dome-like covering which draws exhaust air from the exhaust tube or stack. Thus protection is provided from unwanted environmental elements, such as rain, etc., preventing them from entering the rotary head or exhaust stack as the hemispherical dome-like covering substantially covers the exit hole. The hemispherical dome-like head completely encases the internal exhaust fan providing a unique integral turbine head structure.

As an alternative, a second exhaust fan can be provided on an axle rod supporting the external and internal fans to provide an additional exhaust force. Further, with the construction disclosed and described the turbine head exhaust fan system will also operate as a static ventilator when there is no wind to provide a motive force.

An additional but preferred option is the inclusion of specially configured high efficiency exhaust fan blades which greatly increase the efficiency and capacity to exhaust an enclosed area. In this embodiment the fan blades beneath the hemispherical dome or head and are configured with lower rounded flanges which provide a low pressure area at the duct exit. The upper portion of the fan extending toward the hemispherical dome have a concave surface which provides a high pressure area to increase flow. The outlet area has a second curved flange providing a second low pressure area to draw air out of the vent to the atmosphere. The flanges are also configured to hold a bird guard in the form of concentric rings which prevent birds from entering the vent.

The above and other features of the invention will be fully understood from the following detailed description and the accompanying drawings in which:

DETAILED DESCRIPTION OF THE INVENTION

Figure 1:
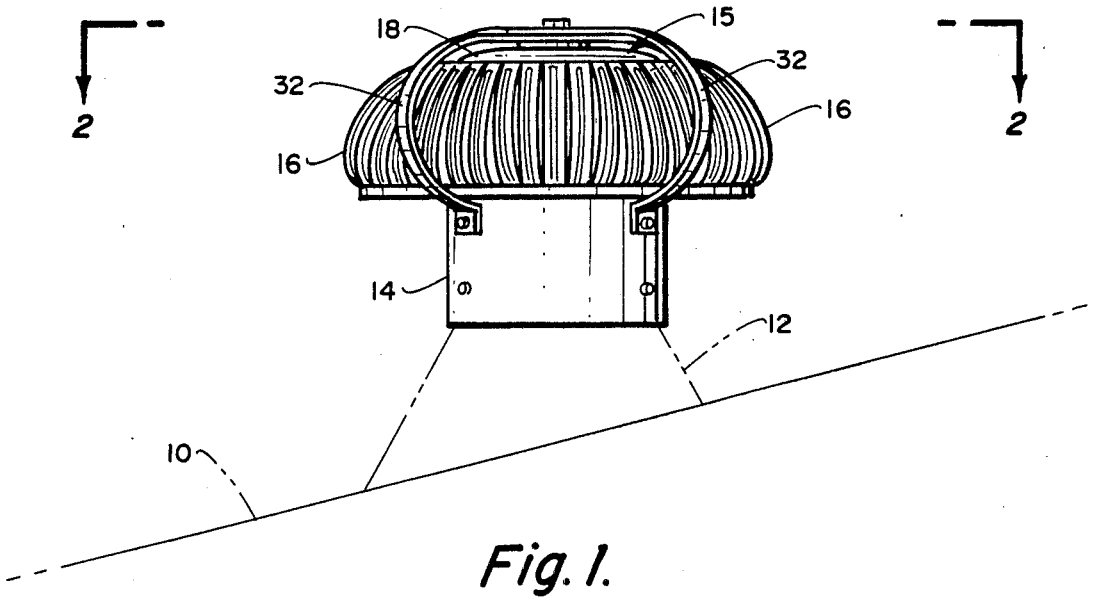
FIG. 1 is a side elevation of the dual fan turbine head ventilator according to the invention mounted on a exhaust tube.

A dual fan turbine head ventilating apparatus is illustrated generally in FIG. 1 mounted on the surface of a roof 10 having a exhaust tube or stack 12. The dual fan turbine head shown generally at 14 is mounted on the exhaust tube 12 by means of an exhaust tube adaptor 14. The ventilating apparatus is driven by external wind powered fins or blades 16 mounted on the external surface of hemispherical shaped dome-like covering 18 which will be described in greater detail herein after.

Figure 2:
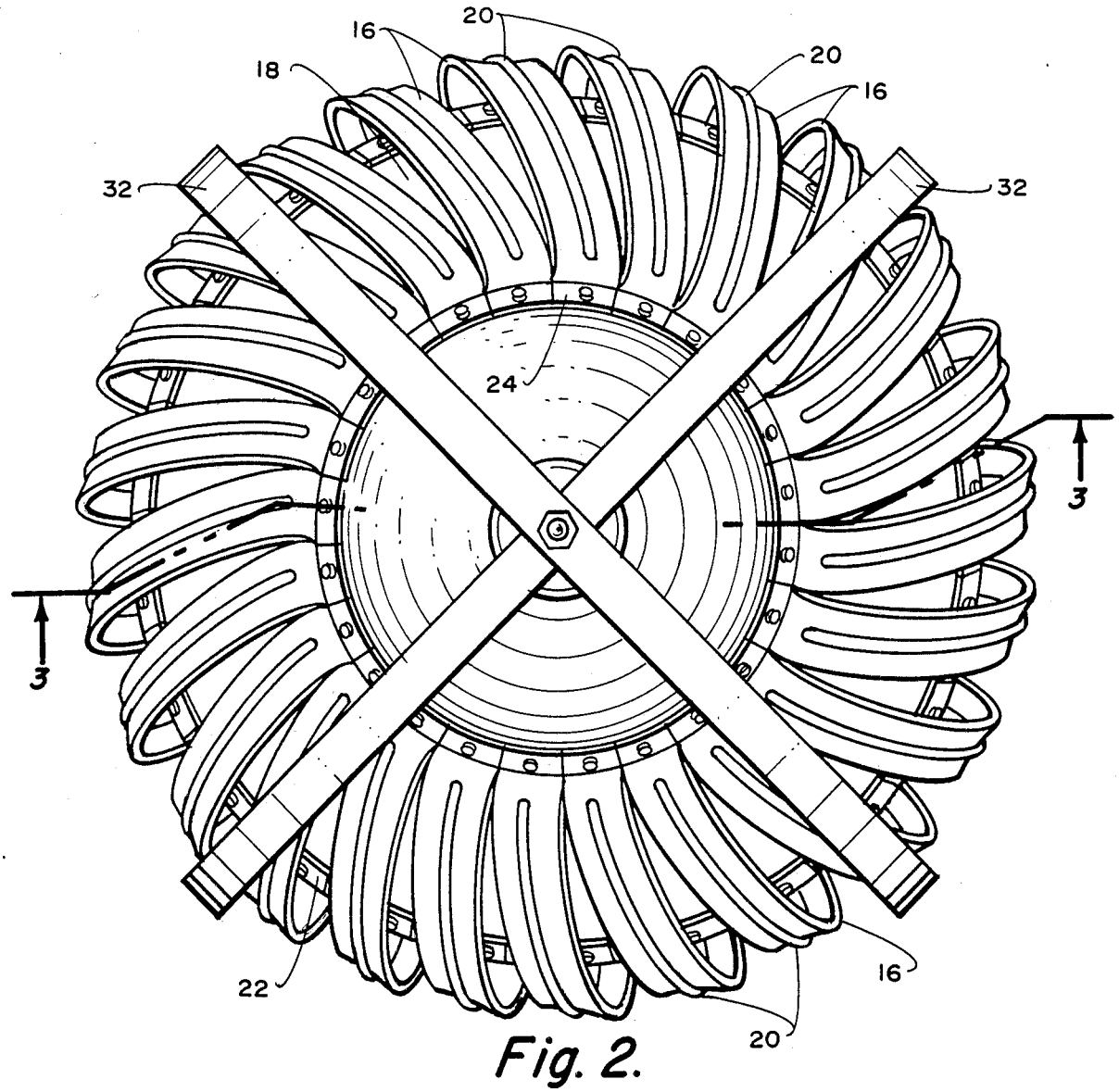
FIG. 2 is a top view of the dual fan turbine head ventilating system taken at 2—2 on FIG. 1.

The top view of FIG. 2 illustrates the construction of the external wind driven fan. The fan is comprised of a plurality of vanes, fins, or cups 16 securely fastened to the external surface of a hemispherical shaped dome-like covering 18 mounted on the exhaust tube adaptor 14. Preferably each fin 16 is provided with a reinforcing rib 20. Each fin 16 is secured to the lower peripheral rim or lip 22 of the hemispherical dome-like covering with the upper end 24 being secured near the apex or top of the hemispherical dome-like covering. The fins may be assembled and fastened by rivets, welding or any other suitable means to provide a wind-driven fan.

Figure 3:
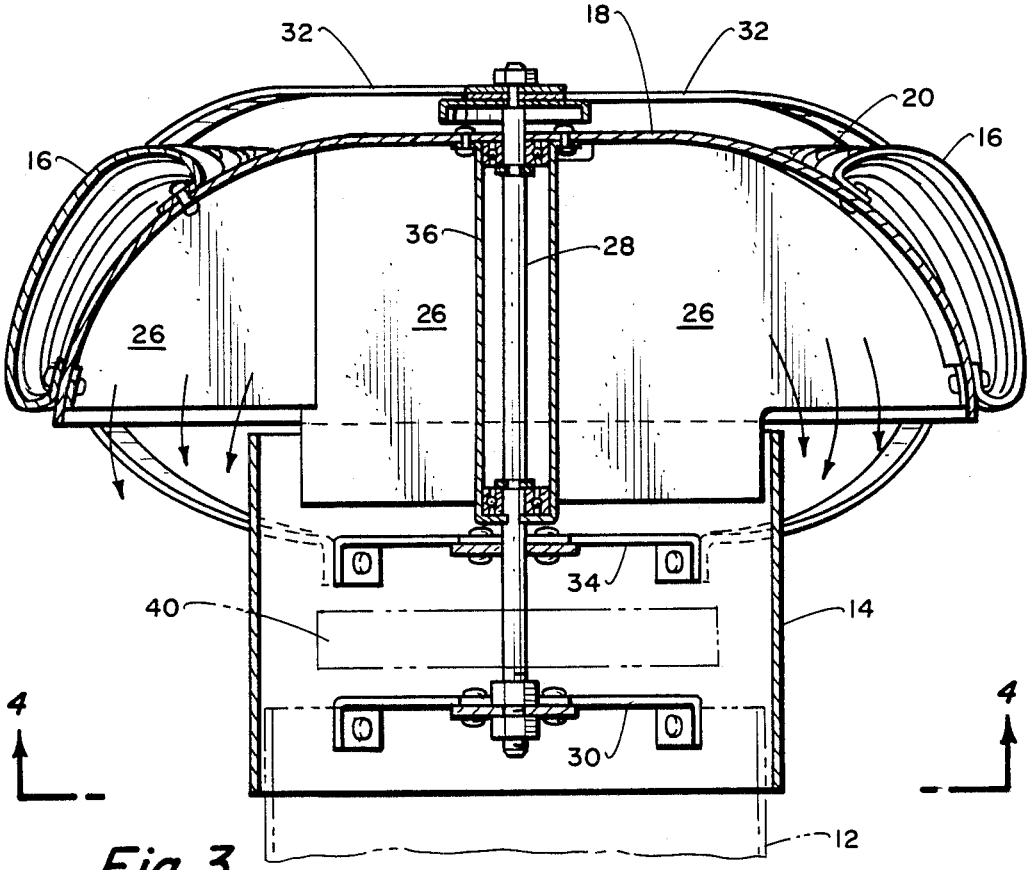
FIG. 3 is a sectional view of the dual fan turbine head ventilating system taken at 3—3 of the FIG. 1.
Figure 4:
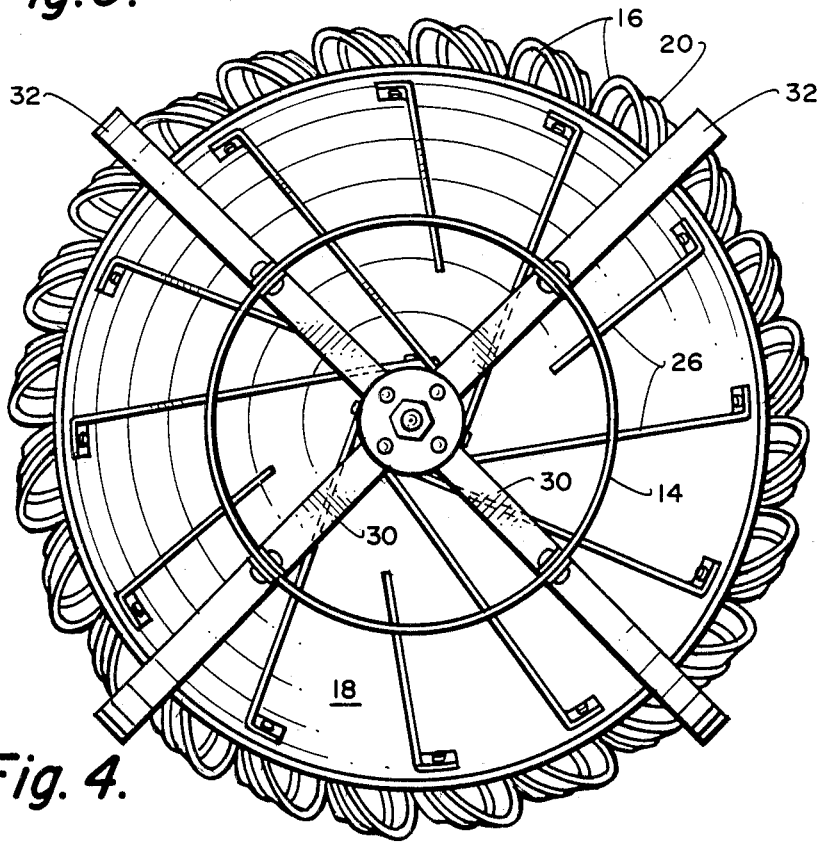
FIG. 4 is a sectional view of the dual fan turbine head exhaust system taken at 4—4 of FIG. 3 slightly reduced in scale.

An internal exhaust fan is illustrated in FIGS. 3 and 4 and is comprised of a plurality of vanes 26 mounted on the interior surface of the hemsipherical dome-like covering 18. Thus, the external fin 16, the hemispherical dome-like covering 18 and the internal vanes 26 provide a turbine head for the ventilating apparatus. The turbine head is mounted for rotation on a rod 28 providing an axle on the which the turbine head can rotate. The axle 28 is securely mounted on axle support brackets 30 fastened to the exhaust tube adaptor 14. Additional support is provided by strap support brackets 32 secured to the upper end of axle 28 and supported at the lower end by mounting brackets 34. This strap mounting system provides additional sturdy support for the turbine head apparatus.

Hub 36 mounted to the hemispherical dome-like covering 18 provides a surface for attaching alternate vanes 26 of the internal exhaust fan to provide a radial offset as can be seen in FIG. 4. Alternate vanes 26 extend substantially the full radius of the hemispherical dome-like covering and are attached to hub 36. The remaining vanes are shorter in length and extend approximately to about half the radius. Air can thus flow up into the hemispherical dome-like covering 18 around the vanes 26 and downward out of the turbine head as illustrated by the arrows in FIG. 3.

An additional exhaust fan could be provided if desired inside the exhaust tube adaptor as indicated in phantom at 40. This additional fan would be in the form of a plurality of vanes or blades attached to the axle rod 28.

In operation the turbine head would be mounted on an exhaust tube or stack 12 by setting the adaptor 14 over the exhaust tube and fastening it by bolts, screws or any other suitable means. In a static operation air would flow up through the exhaust stack 12 the adaptor 14 and downward from the hemsipherical dome-like covering 18 as illustrated by the arrows in FIG. 3.

For wind powered operation the fins 16 would cause the semi-hemispherical dome-like covering 18 to rotate and would provide no competition or opposing force to the function of the internal exhaust fan. As the turbine head apparatus rotates the exhaust fan comprised of the internal vanes 26 would draw air through the stack 12 out of the hemispherical dome-like covering 18 as indicated by the arrows.

Figure 5:
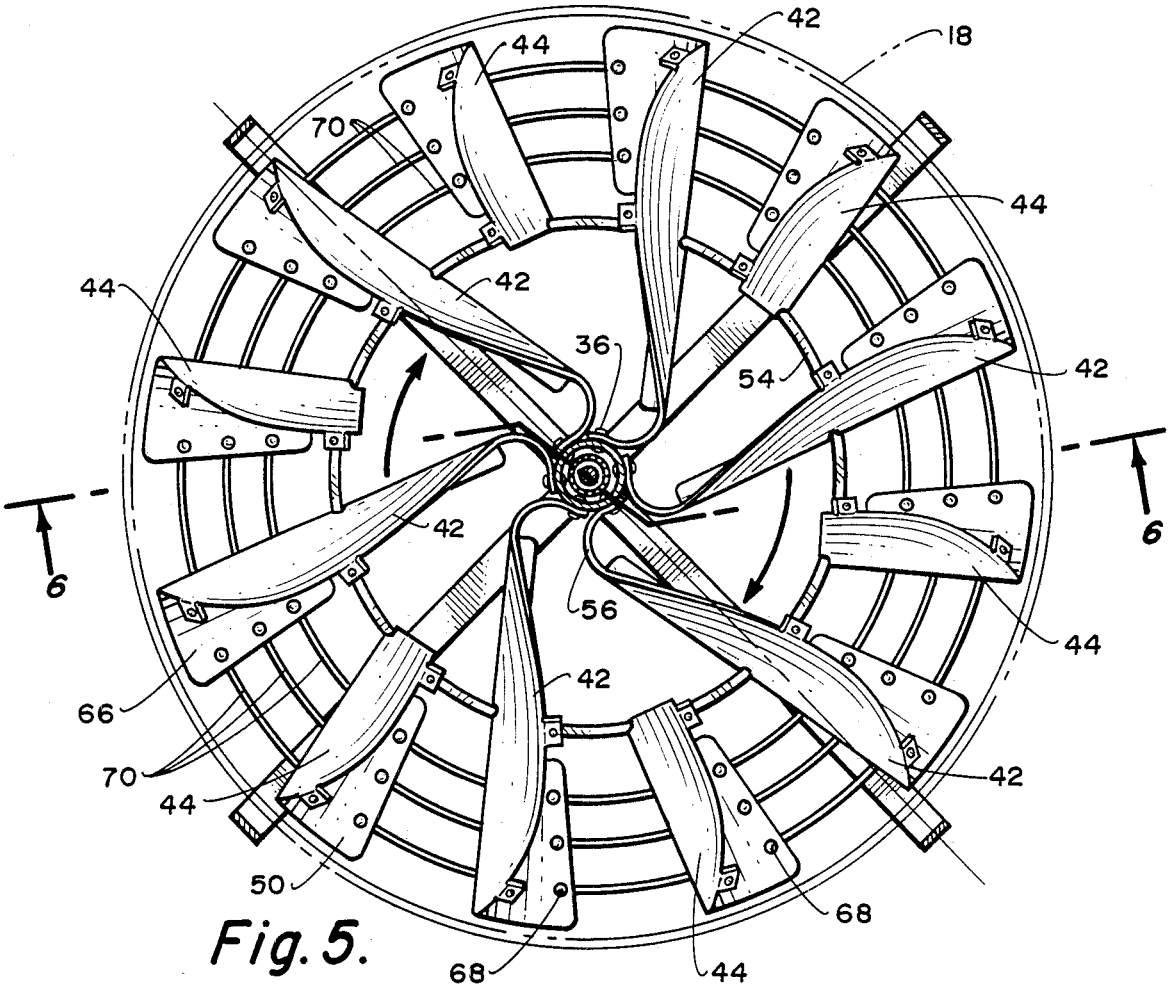
FIG. 5 is a top view of the turbine head exhaust system with specially configured high efficiency blades with the hemispherical dome removed for clarity.
Figure 6:
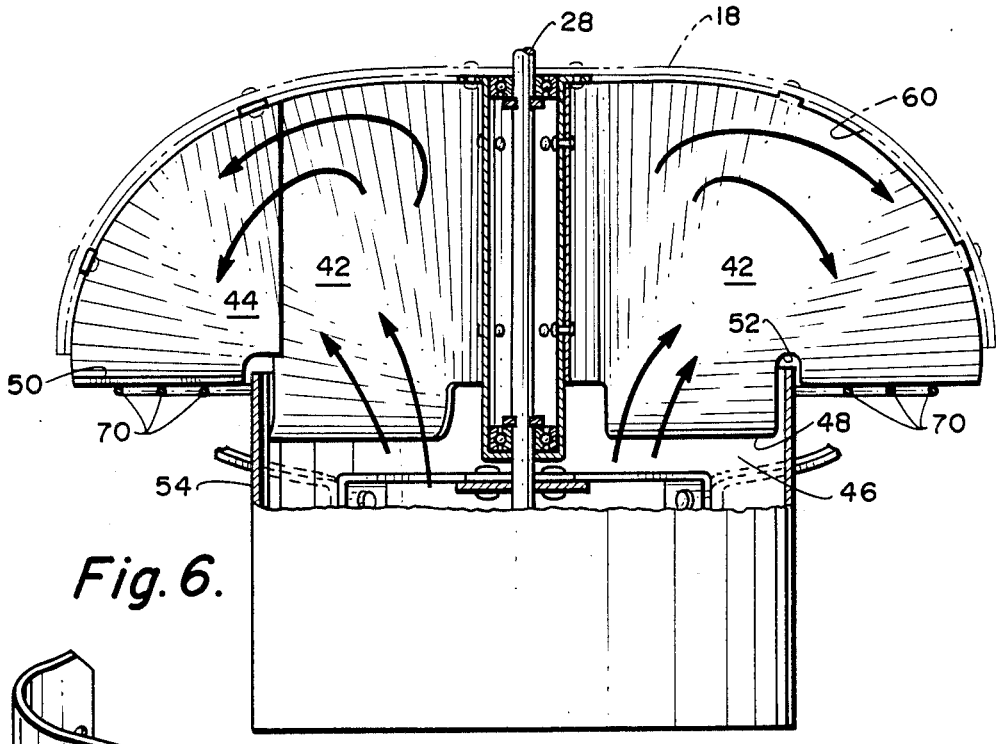
FIG. 6 is a sectional view taken at 6—6 of FIG. 5.

An optional but preferred embodiment of the invention is illustrated in FIGS. 5 through 8. In this embodiment the semi-hemispherical dome-like member is identical with that previously described except that modified high efficiency fan blades 42 and 44 are provided. In FIG. 5 and 6, the hemispherical dome 18 is removed for purposes of illustrating internal fan blade structure. Alternate fan blades 42, 44 are provided with the blades 42 extending the full radius of the hemispherical dome 18 and alternate blades 44 extending approximately half the radius at the outlet. These fan blades are formed to provide high efficiency flow such that air flowing out of the vent tube at 46 over the surface of blades 42 flows from a low pressure area to an increase volume high pressure area increasing the efficiency. The blades 42 have rounded flanges 48 and 50 on lower edge and a notch fitting over the upper edge 52 of mounting duct 54 allowing the lower flange 48 to extend partway into the vent tube. Blades 42 are secured to hub 36 and are offset at 56. The concave curvature at 58 provides an area of increasing pressure at 60 just beneath the hemispherical dome which tends to balance and control pressures from increased flow out of the ventilator.

The high efficiency blades are designed and engineered to produce optimum surfaces with contours to provide balance and control such that point to point variations, velocity distributions and pressures are maximized so that air flow volume at the exit for a given rotational speed in relation to fixed blade area is also maximized. The dynamic function of the blade may be more clearly understood by assuming the air to be static and that it only becomes dynamic when acted upon by the blade. There are three major functional components each being independent but complementing one another which together make up the complete blade function.

The first of these is the function at the tube exit 46 along lower flange 48 of the blade where air is introduced from vent tube 54. Blade flange 48 is contoured or curved to create a leading air foil edge effect which increases air velocity and decreases pressure at the tube exit 46. A low pressure at this point is desirable, to produce a draft at the exit of the tube chamber.

Figure 7:
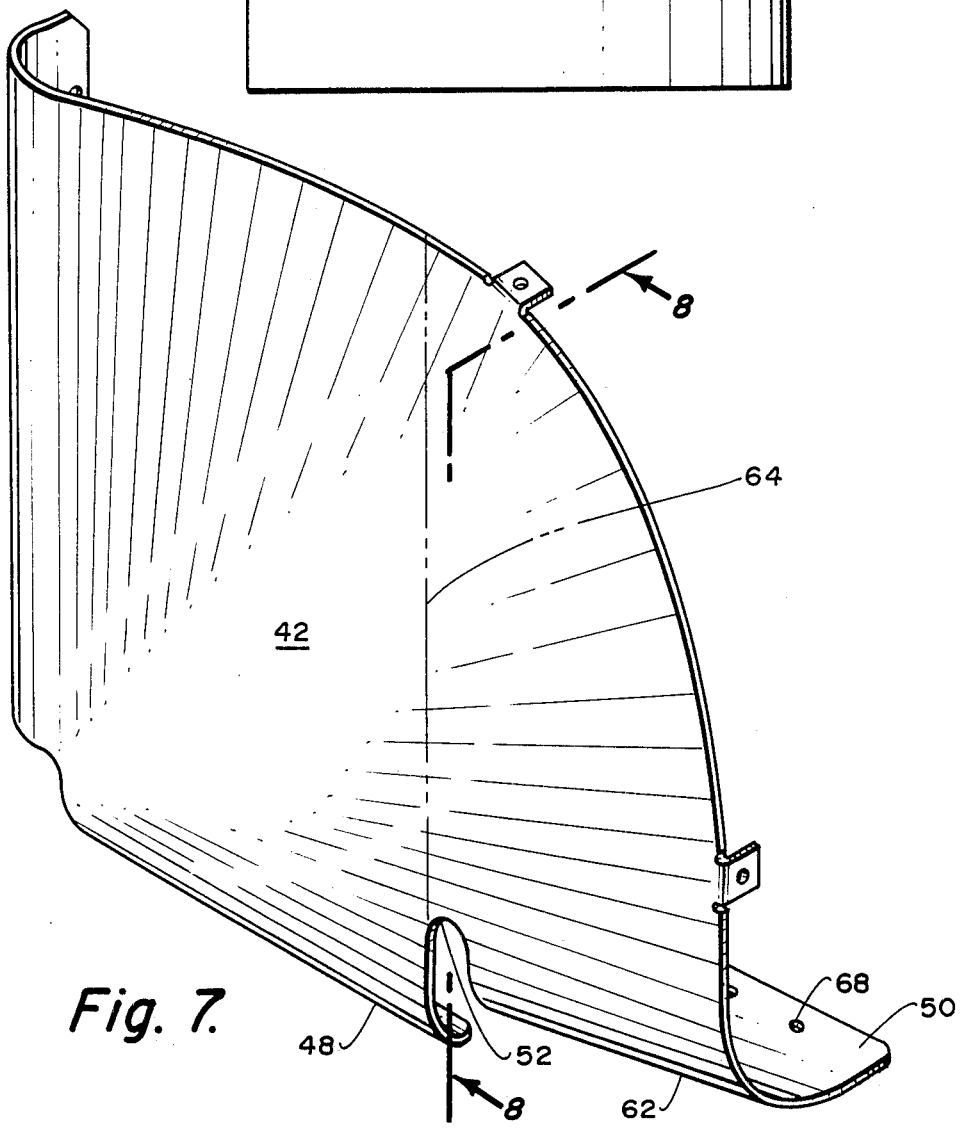
FIG. 7 is a perspective view of the specially configured high efficiency fan blades used in the embodiment of FIG. 5.

The second functional component is along the surface area at reference number 42 of FIG. 7, where exit air is accelerated upward and outward by the tilted concave contour of the blade in relation to its rotation. The tilted or leaned back contour of the blade directs the air radially outward where it makes contact with the hemispherical dome 18 at area 60. The concave contour of the blade concave surface with the deflection of hemispherical dome 18 causes a small reduction in velocity and a desirable increase in pressure at the junction 60 of the blade and dome. However, the total area of the concave surface of the blade is much greater than the entrance area at flange 48 and does therefore not inhibit the flow volume.

Figure 8:
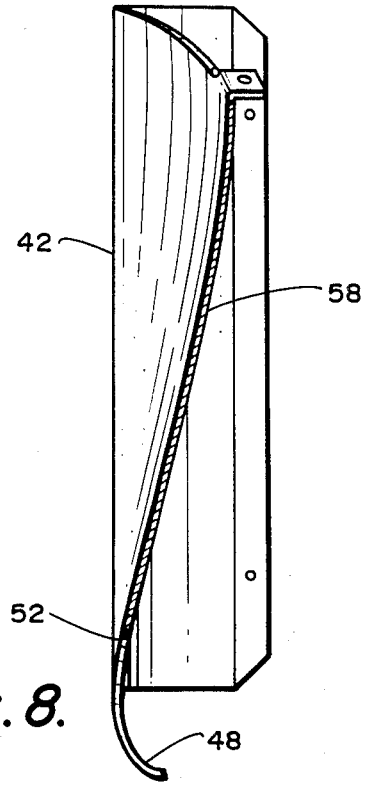
FIG. 8 is a sectional view taken at 8—8 of FIG. 7 to illustrate the concave shape of the high efficiency exhaust vent fan blades.

The third functional component is at the exit or curved flange 50 which in the side view of FIG. 8 can be seen to be a surface of a revolution constituting a semi-conical shape with the apex of the cone pointing inward and converging toward slot 52. As the exit air passes over this semi-conical shape the velocity increases dramatically. The outer or large portion of the semi-conical surface makes contact with the dome, and directs exit air downward and outward. The radius of the outer edge of the semi-conical surface is quite large in relation to the contour of the entrance radius. This large radii again causes a secondary increase in velocity and a secondary decrease in pressure. The pressures at flange 46 and exit flange 50 complement one another as the pressure at flange 50 being lower a final increase of air velocity exiting from the vent tube 54 to the atmosphere is created.

In addition to the above, the blade is formed with a curved radius at the point where it fastens to the axial tube 36 as indicated at 56. This causes the major axial line of the blade to be offset somewhat radially. This radial offset in cooperation with the previously mentioned functional components creates a very high efficiency blade. Increased efficiencies over all presently known wind powered ventilators with the combination of blade hemispherical dome and fins described herein have been demonstrated.

In operation flange 48 provides a low pressure at the exit of the vent tube 54 increasing to an increase in pressure at 60 and then decreasing again to a lower pressure at the forward surface 62 of the flange 50. The combination of the offset from the hub, the low pressure flow over the concave surface to the high pressure area 60 and then back to the low pressure at the exit provides increased efficiency and high volume of flow to vent an enclosed area. The alternate half section blades 44 have substantially the same shape as the outward area indicated by the dotted line 64 in FIG. 7. The half section fan blades 44 also include a flange 66.

Each of the fan blades 42 and 44 have mounting holes 68 for securing a bird guard 70 in the form of circular wires which attach to the fan blade flanges 50 and 66. This unique feature is advantageous as it prevents birds from accidentally entering the duct.

Thus, there has been disclosed a dual fan turbine head ventilating apparatus having external and internal fans which rotate in conjunction with one another but are functionally independent. The disclosed construction provides for more efficient exhausting of air from an enclosed area by a simple wind powered ventilating system.

This invention is not to be limited by the embodiment shown in the drawings or described in the description which is given by way of example and not of limitation but only in accordance with the scope of the appended claims.

What is claimed is:

1. Apparatus for attachment to a vent tube for ventilating an enclosed area comprising;

a tube adaptor for mounting said ventilation apparatus on said vent tube;

rotatable hub means secured to and coaxial with said tube adaptor;

a substantially hemispherical domelike member rotatably secured to said hub means above said tube adaptor;

internal exhaust fan blade means rotatably mounted on the internal surface of said substantially hemispherical domelike member for rotation therewith;

said internal exhaust fan blade means having a lower edge curved under away from the direction of rotation providing a leading edge air foil, and having a titled concave contour away from said leading edge and direction of rotation;

said internal exhaust fan blade means having an intake portion and an exhaust portion; said lower leading edge being at the intake portion; said exhaust portion having a lower edge curved under in a surface of revolution the radius of which is larger than the intake portion curved edge;

said exhaust portion lower curved edge being semiconical in shape with the apex of the cone pointing inward and converging toward a slot in said fan blade means between said intake portion and said exhaust portion;

a plurality of fins mounted on an external surface of said substantially hemispherical domelike member for rotation therewith;

said fins constructed and arranged on said substantially hemispherical domelike member to intercept a wind and thereby rotatably drive said substantially hemispherical domelike member and said internal exhaust fan blade means;

whereby said internal exhaust fan blade means functions to exhaust air from said enclosed area while said substantially hemispherical domelike member provides protection from the entrance of undesirable weather elements to said enclosed area.

2. The apparatus according to claim 1 in which the maximum diameter of said hemispherical covering is up to approximately two times the diameter of said tube adaptor.

3. The apparatus according to claim 2 in which said fan blades alternate in length extending from the interior surface of said hemispherical covering toward said hub.

4. The apparatus according to claim 3 in which alternate vanes are approximately equal in length to the radius of said hemispherical covering.

5. The apparatus according to claim 4 in which there are twelve fan blades equally spaced around said axis of rotation.

6. The apparatus according to claim 5 in which each of said fan blades are at an offset to a radius of said hemispherical dome-like member.

7. The apparatus according to claim 2 includes a second exhaust fan mounted in said tube adaptor.

8. The apparatus according to claim 7 in which said second exhaust fan in mounted for simultaneous rotation with said hemispherical dome-like member.

9. The apparatus according to claim 1 in which said fan blade means has a curved radial flange at its internal end abutting said rotatable hub means; said flange being secured to said hub means so that said fan blade means is offset radially.

* * * * *